US012123613B2

(12) United States Patent
Yuan et al.

(10) Patent No.: US 12,123,613 B2
(45) Date of Patent: Oct. 22, 2024

(54) AIR-CONDITIONING INDOOR UNIT AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Hongliang Yuan, Guangdong (CN); Weidong Zhang, Guangdong (CN); Fenghua Jiang, Guangdong (CN); Zheyuan Zhang, Guangdong (CN); Biao Huang, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 252 days.

(21) Appl. No.: 17/748,319

(22) Filed: May 19, 2022

(65) Prior Publication Data

US 2022/0275965 A1 Sep. 1, 2022

Related U.S. Application Data

(63) Continuation of application No. PCT/CN2020/081184, filed on Mar. 25, 2020.

(30) Foreign Application Priority Data

Nov. 30, 2019 (CN) ..... 201922132171.0

(51) Int. Cl.
*F24F 11/89* (2018.01)
*F24F 1/0011* (2019.01)
(Continued)

(52) U.S. Cl.
CPC ..... *F24F 11/89* (2018.01); *F24F 1/0011* (2013.01); *F24F 13/08* (2013.01); *F24F 13/20* (2013.01)

(58) Field of Classification Search
CPC ..... F24F 11/89; F24F 1/0011; F24F 13/08; F24F 13/20; F24F 2313/205;
(Continued)

(56) References Cited

U.S. PATENT DOCUMENTS

2017/0191676 A1* 7/2017 Jeong ..... F24F 1/0047

FOREIGN PATENT DOCUMENTS

CN 202350268 U 7/2012
CN 108006838 A 5/2018
(Continued)

OTHER PUBLICATIONS

Supplementary European Search Report dated Dec. 22, 2022 received in European Patent Application No. EP 20893884.5.
(Continued)

*Primary Examiner* — Cassey D Bauer
(74) *Attorney, Agent, or Firm* — Scully, Scott, Murphy & Presser, P.C.

(57) ABSTRACT

An air-conditioning indoor unit and an air conditioner are provided. The indoor unit has a frame, a chassis and a sealing member. The frame has an accommodating cavity. The frame is provided on the chassis, and the chassis is located in the accommodating cavity. The chassis and the frame cooperate to form an outlet communicating with the accommodating cavity. The chassis is provided with an accommodating slot adjacent to the outlet. The accommodating slot contains a driving device. The sealing member can seal the accommodating slot.

17 Claims, 7 Drawing Sheets

(51) Int. Cl.
*F24F 13/08* (2006.01)
*F24F 13/20* (2006.01)

(58) Field of Classification Search
CPC ..... F24F 1/0018; F24F 13/1406; F24F 2013/1433; F24F 2013/205
See application file for complete search history.

(56) References Cited

FOREIGN PATENT DOCUMENTS

| | | | |
|---|---|---|---|
| CN | 208253752 | U | 12/2018 |
| CN | 109708202 | A | 5/2019 |
| CN | 107101278 | B | 6/2019 |
| CN | 109916064 | A | 6/2019 |
| CN | 209042555 | U | 6/2019 |
| CN | 209672480 | U | 11/2019 |
| EP | 0769660 | A1 | 4/1997 |
| JP | 2016035349 | A | 3/2016 |
| KR | 20050060558 | A | 6/2005 |
| KR | 20110027509 | A | 3/2011 |
| WO | 2018137438 | A1 | 8/2018 |

OTHER PUBLICATIONS

International Search Report dated Aug. 31, 2020 received in International Application No. PCT/CN2020/081184 together with an English language translation.

* cited by examiner

AIR-CONDITIONING INDOOR UNIT AND AIR CONDITIONER

CROSS-REFERENCE TO RELATED APPLICATIONS

The present application is a continuation application of PCT International Application No. PCT/CN2020/081184, filed on Mar. 25, 2020, which claims the priority to and benefits of Chinese Patent Application No. 201922132171.0, filed on Nov. 30, 2019 and entitled "Air-Conditioning indoor Unit and Air Conditioner", the entire contents of which are incorporated herein by reference for all purposes. No new matter has been introduced.

FIELD

The present application relates to the field of household appliances, and in particular, to an air-conditioning indoor unit and an air conditioner.

BACKGROUND

For most existing indoor units of air conditioners, a driving device is provided on the chassis of an indoor unit, and the driving device is arranged to control rotation of the air deflector of the indoor unit. Due to the existence of a certain gap between the driving device and the frame of the indoor unit, a part of the wind, which is blown from the outlet of the indoor unit, enters the driving device. Thus, it is likely to cause condensation and lead to a safety concern.

The foregoing content is only used to assist in understanding the technical solutions of the present application, and does not mean that the foregoing content is recognized as prior art.

SUMMARY

The main purpose of the present application is to provide an air-conditioning indoor unit, which aims to prevent condensation from being generated on the driving device and improve the safety during operation of the air-conditioning indoor unit.

In order to at least achieve the above purpose, the air-conditioning indoor unit proposed in the present application includes:

- a frame with an accommodating cavity;
- a chassis, wherein the frame is provided on the chassis, and the chassis is located in the accommodating cavity, the chassis and the frame cooperate to form an outlet communicating with the accommodating cavity, and the chassis is provided with an accommodating slot adjacent to the outlet, and the accommodating slot contains a driving device; and
- a sealing member configured to seal the accommodating slot.

Optionally, the sealing member is detachably connected to a slot wall of the accommodating slot.

Optionally, the sealing member is in interference fit with the slot wall of the accommodating slot, and a shape of the sealing member is matched with a shape of an opening of the accommodating slot.

Optionally, the air-conditioning indoor unit further includes an air deflector. The air deflector is rotatably disposed at the outlet and is configured to drive the air deflector to rotate.

Optionally, a side of the sealing member away from the driving device is abutted against an inner wall of the accommodating cavity.

Optionally, a reinforcing member is provided on a surface of the frame facing away from the sealing member.

Optionally, the reinforcing member includes a first reinforcing rib and a second reinforcing rib, and the first reinforcing rib intersects with the second reinforcing rib.

Optionally, the air-conditioning indoor unit further includes an electric control box arranged on the chassis, the frame is provided with a display panel, and the display panel and the electric control box are electrically connected through a connecting wire.

Optionally, the air-conditioning indoor unit further includes a heat exchanger arranged in the accommodating cavity, the heat exchanger is spaced from the chassis, an inner wall of the accommodating cavity is provided with a guide plate adjacent to the electric control box, the guide plate is arranged at intervals from the heat exchanger, and the connecting wire is arranged on a side of the guide plate facing away from the heat exchanger.

Optionally, the guide plate includes a connecting portion and a guide portion, the connecting portion is disposed adjacent to the display panel, the guide portion is disposed adjacent to the electric control box, and a crease is disposed at a connection between the connecting portion and the guide portion.

The present application further proposes an air conditioner, including an air-conditioning outdoor unit and the air-conditioning indoor unit. In particular, the air-conditioning outdoor unit is connected to the air-conditioning indoor unit through a refrigerant pipe.

The air-conditioning indoor unit of the present application includes a frame, a chassis and a sealing member. The frame has an accommodating cavity, the frame is arranged on the chassis, and the chassis is located in the accommodating cavity. The chassis and the frame cooperate to form an outlet communicating with the accommodating cavity, and the chassis is provided with an accommodating slot. The accommodating slot is arranged adjacent to the outlet, and contains a driving device. The accommodating slot is sealed by the sealing member, such that hot air or cold air blown from the outlet is prevented from being poured into the accommodating slot to generate condensation on the driving device. Thus, normal use of the driving device and high safety performance can be ensured.

BRIEF DESCRIPTION OF THE DRAWINGS

In order to more clearly illustrate the technical solutions in the embodiments of the present application or in the related art, the following will briefly introduce the drawings required in the description of the embodiments or the related art. Obviously, the drawings in the following description are only some embodiments of the present application. For those of ordinary skill in the art, other drawings can also be obtained according to the structure shown in these drawings without paying creative labor.

Figure 1:
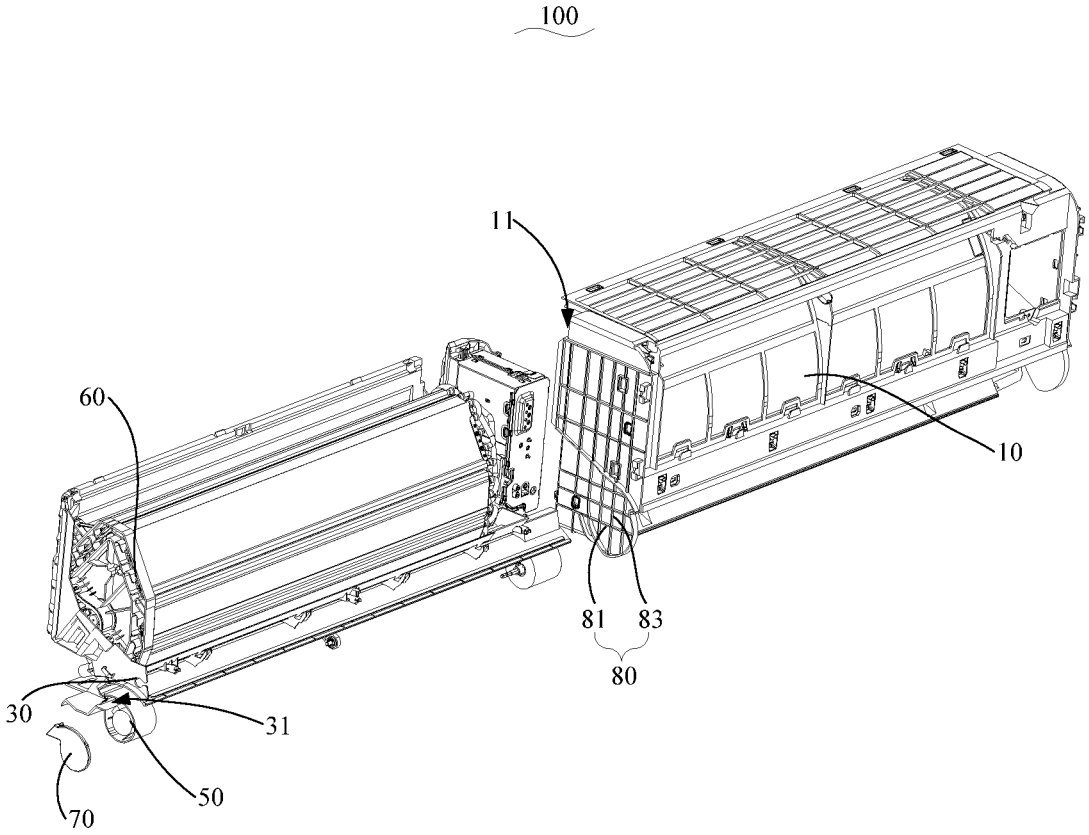
FIG. 1 is a partial explosion view of an air-conditioning indoor unit according to an embodiment of the present application.
Figure 2:
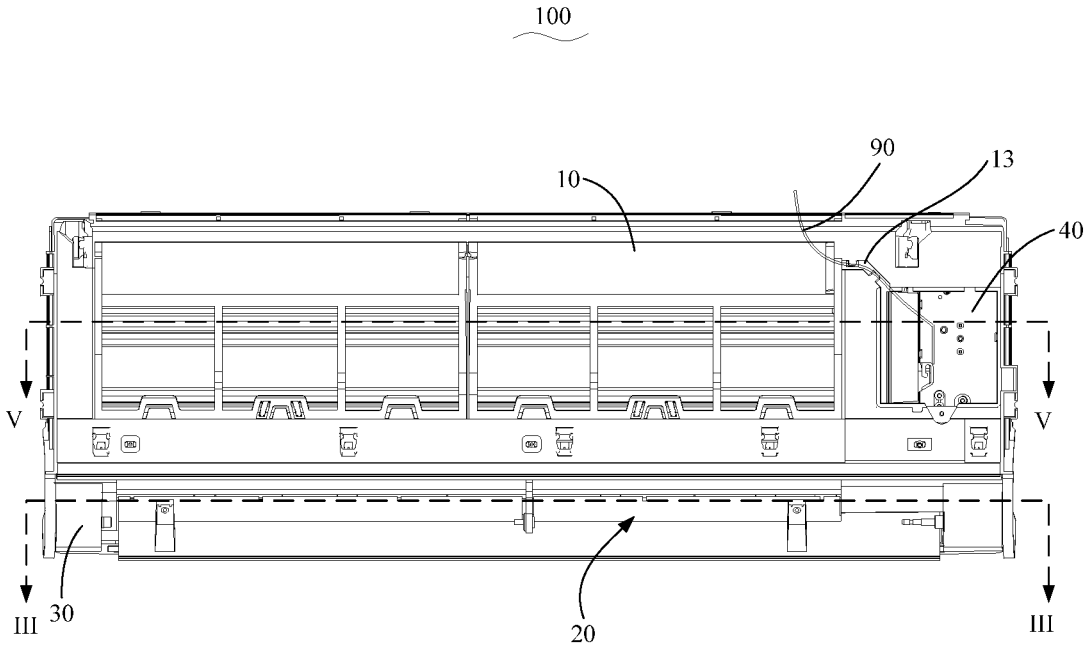
FIG. 2 is a schematic structural view of an air-conditioning indoor unit according to an embodiment of the present application.
Figure 3:
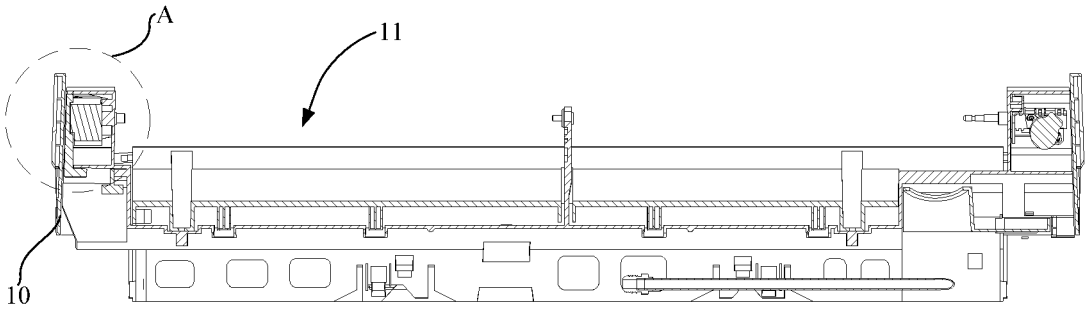
FIG. 3 is a cross-sectional view of the air-conditioning indoor unit of FIG. 2 along the surface.

Description of reference numerals shown in the figures is provided in the following table.

| Reference Numeral | Name |
|---|---|
| 100 | Air-conditioning indoor unit |
| 10 | Frame |
| 11 | Accommodating cavity |
| 13 | Guide plate |
| 131 | Connecting portion |
| 133 | Guide portion |
| 135 | Crease |
| 20 | Outlet |
| 30 | Chassis |
| 31 | Accommodating slot |
| 40 | Electric control box |
| 50 | Driving device |
| 60 | Heat exchanger |
| 70 | Sealing member |
| 80 | Reinforcing member |
| 81 | First reinforcing rib |
| 83 | Second reinforcing rib |
| 90 | Connecting wire |

The realization of the purpose, functional features, and advantages of the present application will be further described with reference to the accompanying drawings in conjunction with the embodiments.

DETAILED DESCRIPTION OF EMBODIMENTS

The following description will clearly and completely describe the technical schemes in the embodiments of the present application with reference to the drawings in the embodiments of the present application. Obviously, the described embodiments are only part of the embodiments of the present application, not all of them. Based on the embodiments in the present application, all other embodiments obtained by ordinary skills in the art without creative labor are within the claimed scope of the present application.

It should be noted that all directional indications (such as up, down, left, right, front, back, etc.) in the embodiments of the present application are only set to explain the relative positional relationship, movement situation, etc. between components under a specific posture (as shown in the drawings). If the specific posture is changed, the directional indications are changed accordingly.

In the present application, unless otherwise expressly specified and qualified, the terms "connected", "fixed", and the like. should be understood in a broad sense. For example, "fixed" can be a fixed connection, a detachable connection, or be integrated into one; it can be mechanically connected or electrically connected; it can be directly connected or indirectly connected through an intermediate medium, it can be the internal communication of two elements or the interaction relationship between two elements, unless otherwise clearly defined. For those of ordinary skilled in the art, the specific meaning of the above-mentioned terms in the present application can be understood according to specific circumstances.

In addition, the description in the present application related to "first", "second", etc. is for descriptive purposes only and cannot be understood as indicating or implying the relative importance thereof or implying the number of technical features indicated. Therefore, the features defined with "first" or "second" can explicitly or implicitly include at least one of the features. In addition, the technical solutions of various embodiments can be combined with each other, but it must be based on the realization of ordinary skills in the field. When the combination of technical solutions is contradictory or impossible, it should be considered that the combination of such technical solutions does not exist and is not within the scope of the present application.

The present application provides an air-conditioning indoor unit 100, according to an aspect of the present application.

According to FIG. 1 to FIG. 4, according to certain exemplary embodiments of the present application, the air-conditioning indoor unit 100 includes:

a frame 10 with an accommodating cavity 11;

a chassis 30, where the frame 10 is arranged on the chassis 30, and the chassis 30 is located in the accommodating cavity 11, the chassis 30 and the frame 10 cooperate to form an outlet 20 communicating with the accommodating cavity 11, the chassis 30 is provided with an accommodating slot 31, the accommodating slot 31 is arranged adjacent to the outlet 20, and the accommodating slot 31 contains a driving device 50; and a sealing member 70 configured to seal the accommodating slot 31.

For example, the frame 10 mainly plays a supporting role, and the frame 10 is usually made of lightweight materials, such as, plastic. The air-conditioning indoor unit 100 further includes a heat exchanger 60 and a fan (not shown) located in the accommodating cavity 11. The fan is arranged on the chassis 30, the heat exchanger 60 is arranged around the fan, and an outlet end of the fan is in communication with the outlet 20. The driving device 50 can be configured to drive the fan or an air deflector to rotate. Since the driving device 50 is disposed adjacent to the outlet 20, in an embodiment, the air-conditioning indoor unit 100 further includes the air deflector (not shown), the air deflector is rotatably disposed at the outlet 20, and the driving device 50 is configured to drive the air deflector to rotate.

The accommodating slot 31 can be arranged at any position of the chassis 30 close to the outlet 20. In order to reduce the cross-sectional size of the air-conditioning indoor unit 100 of the air conditioner and increase the radial size of the air-conditioning indoor unit 100, the accommodating slot 31 can be provided at an end of the chassis 30. An orientation of an opening of the accommodating slot 31 can be parallel to an orientation of the outlet 20; alternatively, the orientation of the opening of the accommodating slot 31 and the orientation of the outlet 20 can form an included angle. The sealing member 70 seals the accommodating slot 31. There can be a gap or no gap between the sealing member 70 and an inner wall of the accommodating cavity 11, as long as the sealing member 70 seals the accommodating slot 31. All those solutions are within the claimed scope of the present application. The sealing member 70 can be of a plastic or rubber material, which provides elasticity and has a good sealing effect.

The air-conditioning indoor unit 100 of the present application includes a frame 10, a chassis 30 and a sealing member 70. The frame 10 has an accommodating cavity 11, the frame 10 is arranged on the chassis 30, the chassis 30 is located in the accommodating cavity 11, the chassis 30 and the frame 10 cooperate to form an outlet 20 communicating with the accommodating cavity 11, an end of the chassis 30 close to the frame 10 is provided with an accommodating slot 31, the accommodating slot 31 contains a driving device 50, and the accommodating slot 31 is sealed by a sealing member 70. As such, hot air or cold air blown from the outlet 20 is prevented from being poured into the accommodating slot 31 to generate condensation on the driving device 50, so as to ensure the normal use of the driving device 50 and high safety performance.

Further, in order to facilitate the replacement of the sealing member 70, the sealing member 70 is detachably connected to a slot wall of the accommodating slot 31. The detachable connection can be a screw connection or a buckle connection.

Figure 4:
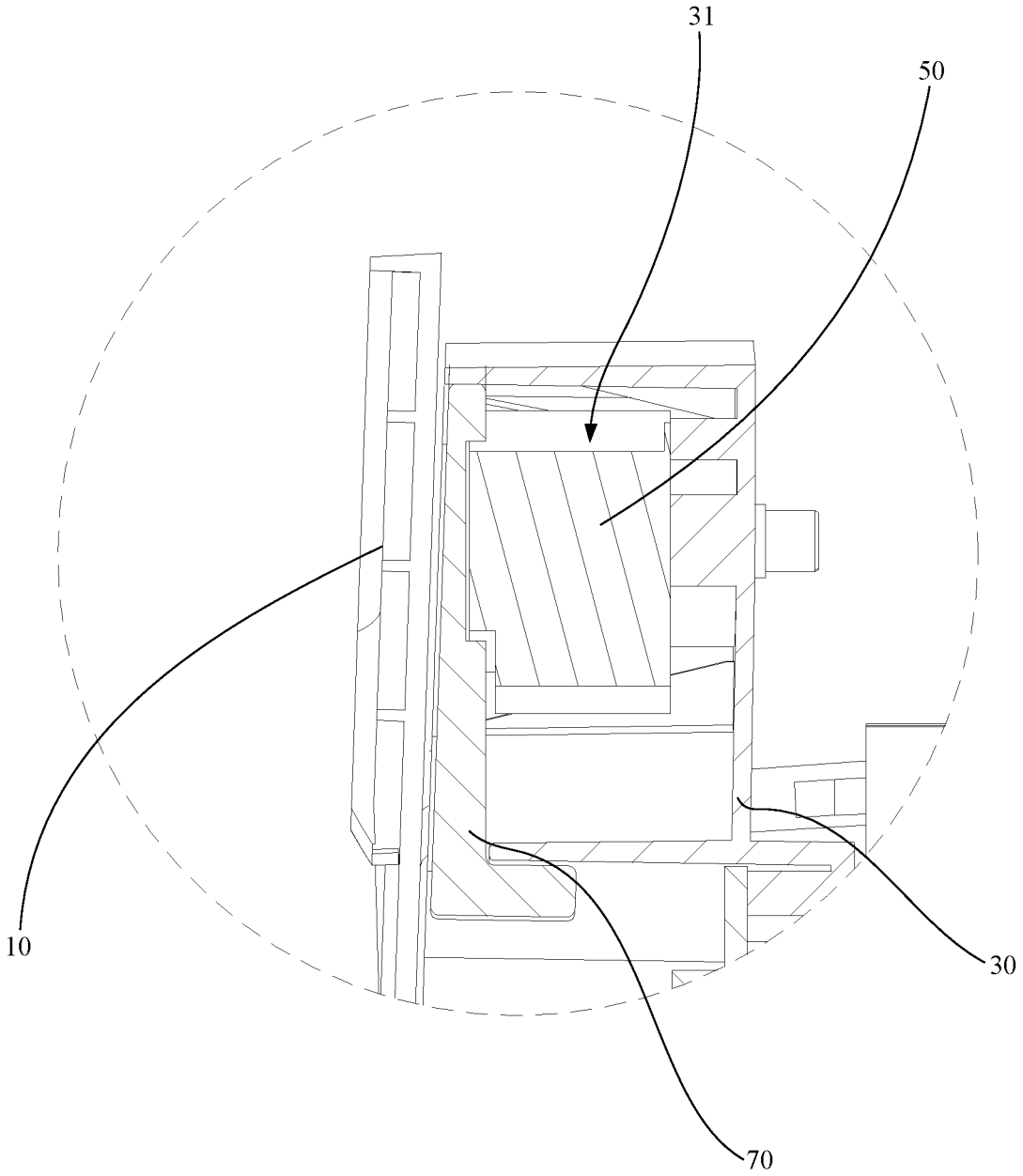
FIG. 4 is a partial enlarged view of portion A of FIG. 3.

According to FIG. 4, in an embodiment, the sealing member 70 is in interference fit with the slot wall of the accommodating slot 31, which can save the installation cost. When the interference fit amount is between 0.5 mm and 3 mm, the sealing performance is satisfactory. The shape of the sealing member 70 matches a shape of the opening of the accommodating slot 31. In this embodiment, the accommodating slot 31 is elliptical, and the sealing member 70 is accordingly elliptical. In other embodiments, the accommodating slot 31 may have a circular or a square shape, which is not limited here.

In an embodiment, in order to improve the stability of the connection between the sealing member 70 and the accommodating slot 31, to prevent a size of the gap between the sealing member 70 and the inner wall of the accommodating slot 31 from increasing, resulting in the occurrence of a moisture unqualified phenomenon of the driving device 50, a side of the sealing member 70 away from the driving device 50 abuts against an inner wall of the accommodating cavity 11. The sealing member 70 is thus not easily released from the accommodating slot 31.

Further, in order to further improve the stability of the connection between the sealing member 70 and the accommodating slot 31, the surface of the frame 10 facing away from the sealing member 70 is provided with a reinforcing member 80 to increase strength and rigidity of the frame 10.

According to FIG. 1, the reinforcing member 80 includes a first reinforcing rib 81 and a second reinforcing rib 83, and the first reinforcing rib 81 intersects with the second reinforcing rib 83. There may be a plurality of first reinforcing ribs 81, and the plurality of first reinforcing ribs 81 are long strips, spaced from each other and parallel to each other. There are a plurality of second reinforcing ribs 83, and the plurality of second reinforcing ribs 83 are long strips, spaced from each other and parallel to each other. Each of the first reinforcing ribs 81 intersects with a second reinforcing member 83, which can greatly improve the overall strength of the reinforcing member 80.

According to FIG. 5 to FIG. 9, the air-conditioning indoor unit 100 further includes an electric control box 40 arranged on the chassis 30, the frame 10 is provided with a display panel (not shown), and the display panel and the electric control box 40 are electrically connected through a connecting wire 90.

The air-conditioning indoor unit 100 further includes a heat exchanger 60 arranged in the accommodating cavity 11, the heat exchanger 60 is arranged at intervals from the chassis 30, an inner wall of the accommodating cavity 11 is provided with a guide plate 13, the guide plate 13 is arranged adjacent to the electric control box 40, and the guide plate 13 is arranged at intervals from the heat exchanger 60. The connecting wire 90 is arranged on a side of the guide plate 13 facing away from the heat exchanger 60.

In this embodiment, the display panel is mainly configured to display a working state of the air-conditioning indoor unit 100, and is electrically connected to the electric control box 40 through the connecting wire 90. In order to prevent the connecting wire 90 from contacting the heat exchanger 60, causing generation of condensed water on an outer surface of the connecting wire 90, and leading to potential safety hazards, a guide plate 13 is provided on the inner wall of the accommodating cavity 11. The guide plate 13 is arranged at intervals from the heat exchanger 60 and a gap is provided between the two, the connecting wire 90 is provided on the side of the guide plate 13 facing away from the heat exchanger 60, so that the connecting wire 90 can be prevented from directly contacting the heat exchanger 60.

In order to adapt to different types of electric control boxes 40, the guide plate 13 needs to be arranged in an easy-to-be disassembled structure. For example, the guide plate 13 includes a connecting portion 131 and a guide portion 133, the connecting portion 131 is arranged adjacent to the display panel, and the guide portion 133 is arranged adjacent to the electric control box 40. A crease 135 is arranged at a connection between the connecting portion 131 and the guide portion 133.

Figure 5:
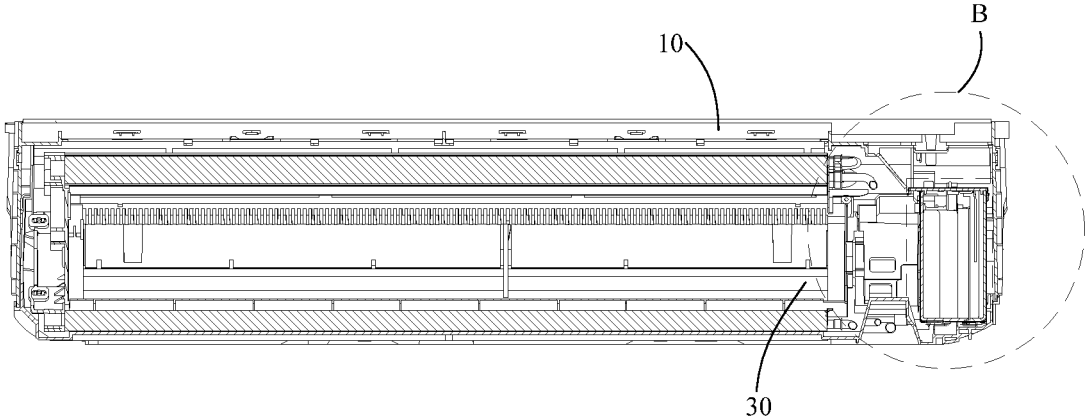
FIG. 5 is a cross-sectional view of the air-conditioning indoor unit of FIG. 2 along the V-V surface.
Figure 6:
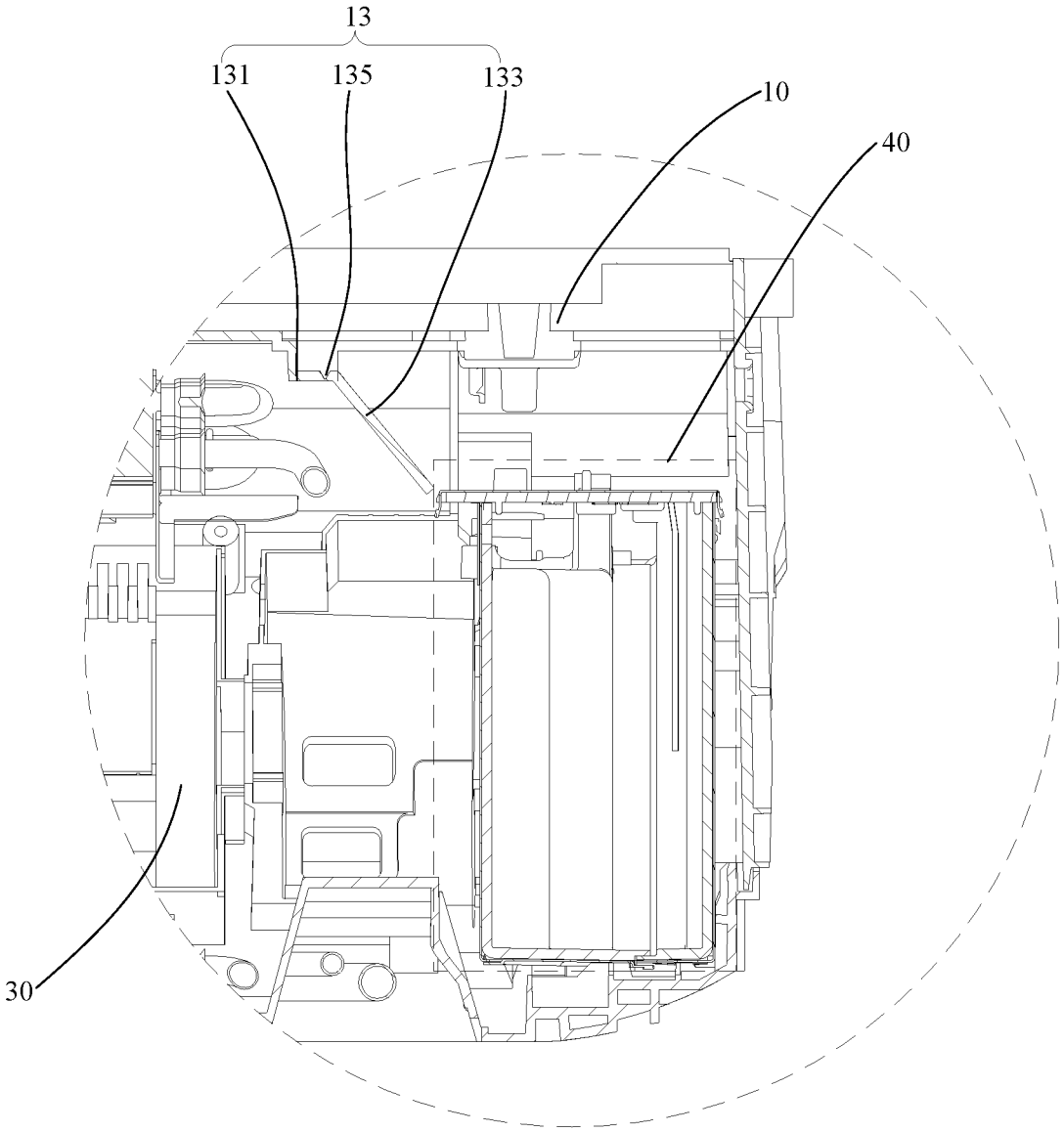
FIG. 6 is a partial enlarged view of portion B of FIG. 5.

According to FIG. 5 and FIG. 6, a size of the electric control box 40 is relatively small, so that a distance between the guide plate 13 and the electric control box 40 is relatively long. In order to avoid contact between the connecting wire 90 and the heat exchanger 60, the guide portion 133 is inclined, the connecting wire 90 can be connected with the electric control box 40 by the guide portion 133, and the outer surface of the connecting wire 90 is not prone to condensed water, and the safety can be ensured.

Figure 7:
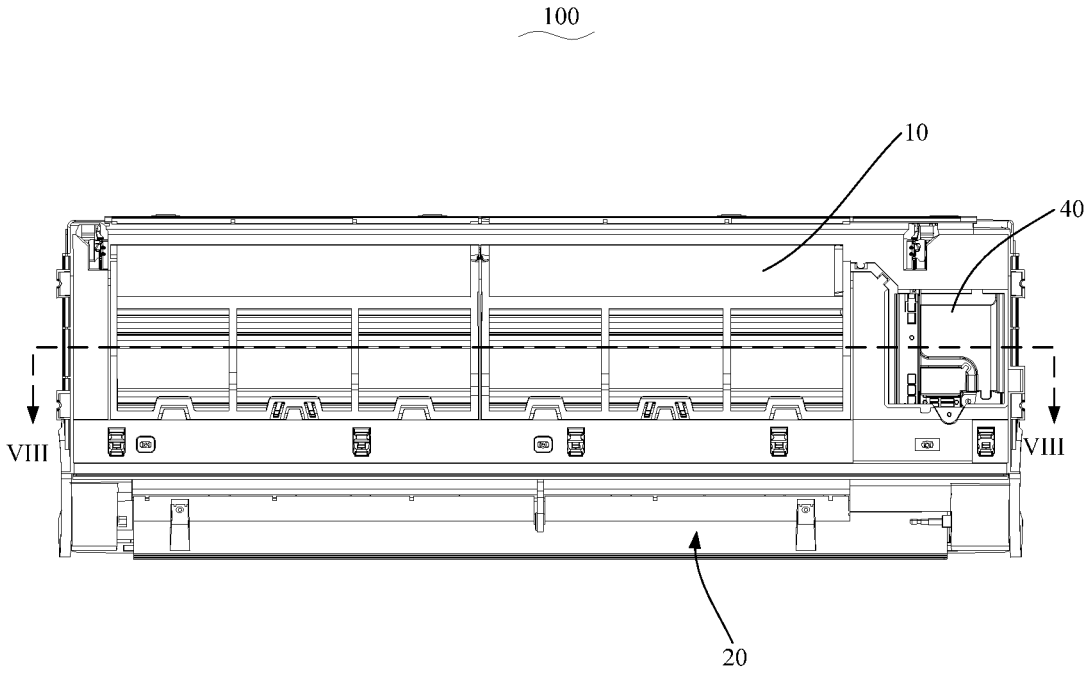
FIG. 7 is a schematic structural view of an air-conditioning indoor unit according to another embodiment of the present application.
Figure 8:
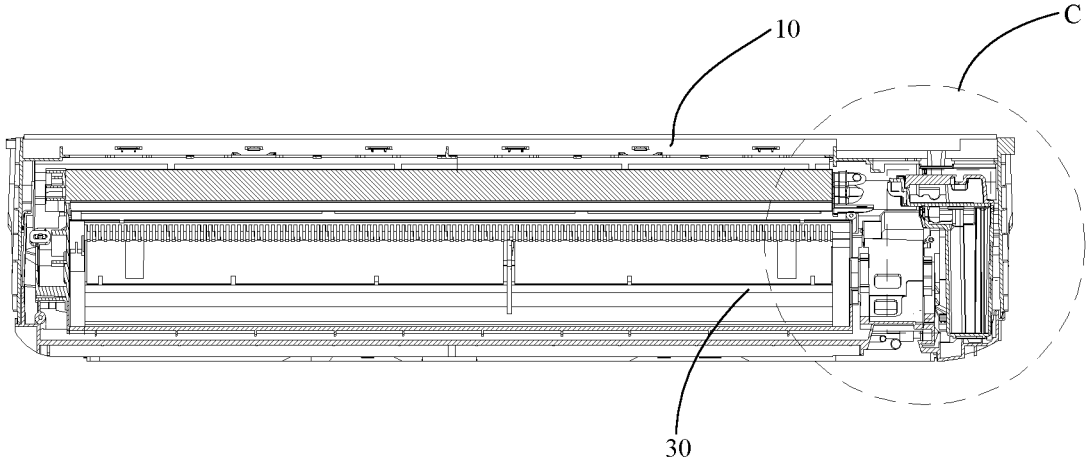
FIG. 8 is a cross-sectional view of the air-conditioning indoor unit of FIG. 7 along the VIII-VIII surface.
Figure 9:
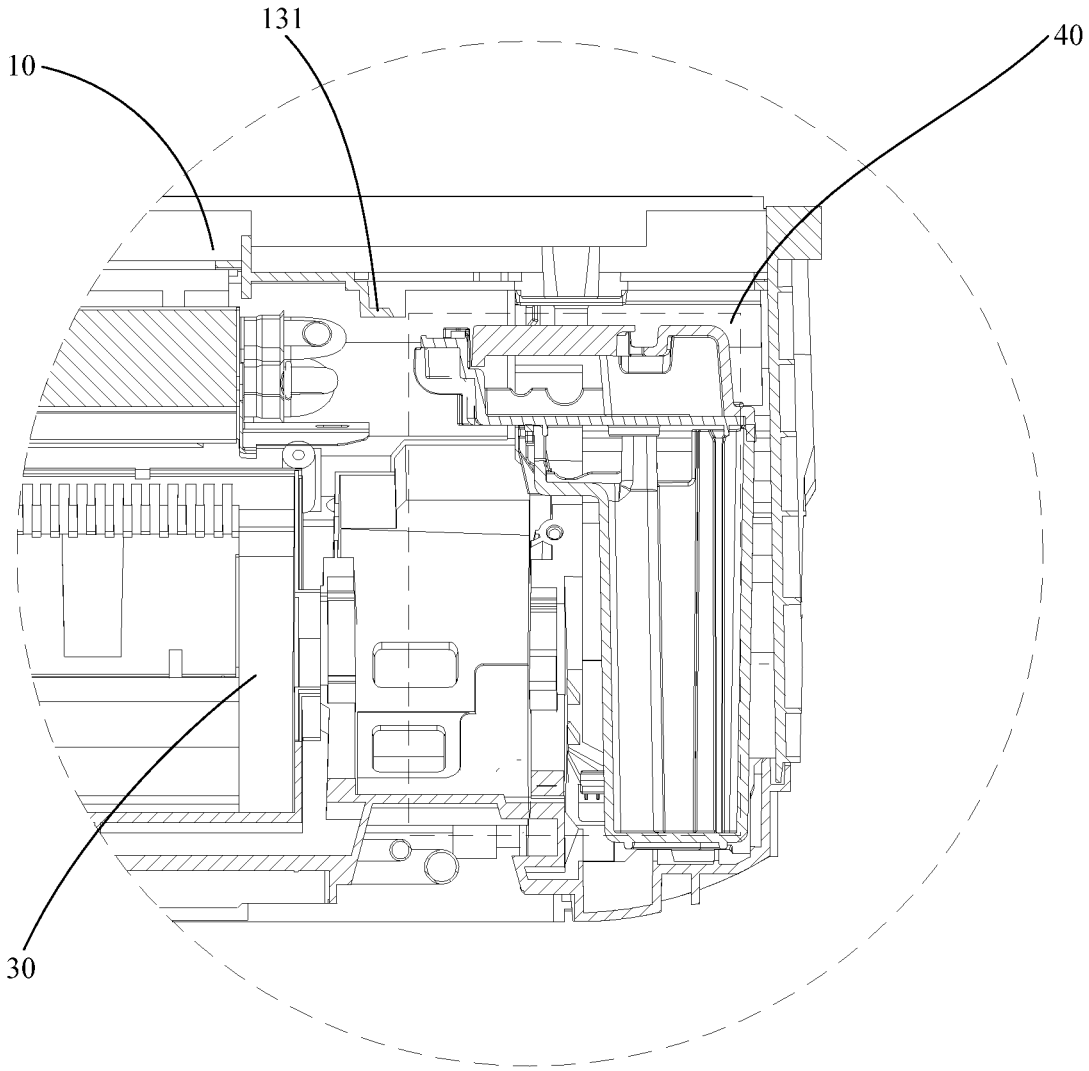
FIG. 9 is a partial enlarged view of portion C of FIG. 8.

In another embodiment, according to FIG. 7 to FIG. 9, the electric control box 40 is relatively large in size, and a distance between the guide plate 13 and the electric control box 40 is significantly short. In order to prevent the guide plate 13 from interfering with the electric control box 40, the guide portion 133 is breakable through the crease 135, the crease 135 is a V-shaped structure, and a bottom end of the V-shaped has the weakest strength, which is easy to be broken and easy to install the electric control box 40.

The present application further provides an air conditioner, which includes an air-conditioning indoor unit 100. The specific structure of the air-conditioning indoor unit 100 refers to the above embodiments. Since the air conditioner adopts all the technical solutions of the above embodiments, it has at least all the functions brought by the technical solutions of the above embodiments of the air-conditioning indoor unit, which will not be repeated here.

The air conditioner further includes an air-conditioning indoor unit (not shown), and the air-conditioning outdoor unit 100 is connected to the air-conditioning indoor unit through a refrigerant pipe.

The above description is only a preferred embodiment of the present application, and does not therefore limit the patent scope of the present application. Any equivalent structural transformation made under the inventive concept of the present application using the specification and the accompanying drawings, or direct/indirect application in other related technical fields, is included in the claimed scope of the present application.

What is claimed is:

1. An air-conditioning indoor unit comprising:

a frame with an accommodating cavity;

a chassis, wherein the frame is provided on the chassis, and the chassis is located in the accommodating cavity, the chassis and the frame cooperate to form an outlet communicating with the accommodating cavity, and the chassis is provided with an accommodating slot adjacent to the outlet, and the accommodating slot contains a motor; and a cover configured to seal the accommodating slot, wherein a side of the cover, away from the motor, is abutted against an inner wall of the accommodating cavity.

2. The air-conditioning indoor unit according to claim 1, wherein the cover is detachably connected to a slot wall of the accommodating slot.

3. The air-conditioning indoor unit according to claim 2, wherein the cover is in interference fit with the slot wall of the accommodating slot, and a shape of the cover is matched with a shape of an opening of the accommodating slot.

4. The air-conditioning indoor unit according to claim 1, further comprising an air deflector, wherein the air deflector is rotatably disposed at the outlet and the motor is configured to drive the air deflector to rotate.

5. The air-conditioning indoor unit according to claim 1, wherein a reinforcing member is provided on a surface of the frame facing away from the cover.

6. The air-conditioning indoor unit according to claim 5, wherein:

the reinforcing member comprises a first reinforcing rib and a second reinforcing rib; and the first reinforcing rib intersects with the second reinforcing rib.

7. The air-conditioning indoor unit according to claim 1, further comprising:

an electric control box arranged on the chassis, wherein the frame is provided with a display panel, and the display panel and the electric control box are electrically connected through a connecting wire; and a heat exchanger arranged in the accommodating cavity, wherein the heat exchanger is spaced from the chassis, an inner wall of the accommodating cavity is provided with a guide plate adjacent to the electric control box, the guide plate is arranged at intervals from the heat exchanger, and the connecting wire is arranged on a side of the guide plate facing away from the heat exchanger.

8. The air-conditioning indoor unit according to claim 7, wherein:

the guide plate comprises a connecting portion and a guide portion;

the connecting portion is disposed adjacent to the display panel;

the guide portion is disposed adjacent to the electric control box; and a crease is disposed at a connection between the connecting portion and the guide portion.

9. An air conditioner comprising:

an air-conditioning outdoor unit; and an air-conditioning indoor unit, wherein the air-conditioning outdoor unit is connected to the air-conditioning indoor unit through a refrigerant pipe, wherein the air-conditioning indoor unit comprises:

a frame with an accommodating cavity;

a chassis, wherein the frame is provided on the chassis, and the chassis is located in the accommodating cavity, the chassis and the frame cooperate to form an outlet communicating with the accommodating cavity, and the chassis is provided with an accommodating slot adjacent to the outlet, and the accommodating slot contains a motor; and a cover configured to seal the accommodating slot, wherein a side of the cover, away from the motor, is abutted against an inner wall of the accommodating cavity.

10. The air conditioner according to claim 9, wherein the cover is detachably connected to a slot wall of the accommodating slot.

11. The air conditioner according to claim 10, wherein the cover is in interference fit with the slot wall of the accommodating slot, and a shape of the cover is matched with a shape of an opening of the accommodating slot.

12. The air-conditioning indoor unit according to claim 9, further comprising an air deflector, wherein the air deflector is rotatably disposed at the outlet and the motor is configured to drive the air deflector to rotate.

13. The air conditioner according to claim 9, wherein a reinforcing member is provided on a surface of the frame facing away from the cover.

14. The air conditioner according to claim 13, wherein:

the reinforcing member comprises a first reinforcing rib and a second reinforcing rib; and the first reinforcing rib intersects with the second reinforcing rib.

15. The air conditioner according to claim 9, wherein the air-conditioning indoor unit further comprising:

an electric control box arranged on the chassis, wherein the frame is provided with a display panel, and the display panel and the electric control box are electrically connected through a connecting wire; and a heat exchanger arranged in the accommodating cavity, wherein the heat exchanger is spaced from the chassis, an inner wall of the accommodating cavity is provided with a guide plate adjacent to the electric control box, the guide plate is arranged at intervals from the heat exchanger, and the connecting wire is arranged on a side of the guide plate facing away from the heat exchanger.

16. The air conditioner according to claim 15, wherein:

the guide plate comprises a connecting portion and a guide portion;

the connecting portion is disposed adjacent to the display panel;

the guide portion is disposed adjacent to the electric control box; and a crease is disposed at a connection between the connecting portion and the guide portion.

17. An air-conditioning indoor unit comprising:

a frame with an accommodating cavity;

a chassis, wherein the frame is provided on the chassis, and the chassis is located in the accommodating cavity, the chassis and the frame cooperate to form an outlet communicating with the accommodating cavity, and the chassis is provided with an accommodating slot adjacent to the outlet, and the accommodating slot contains a motor;

a cover configured to seal the accommodating slot, wherein a side of the cover, away from the motor, is abutted against an inner wall of the accommodating cavity; and wherein an opening of the accommodating slot faces towards a side of the frame away from the outlet, and the cover is located between the accommodating cavity and the frame to seal the opening of the accommodating slot.

* * * * *